US012571200B1

(12) United States Patent
Kasper et al.

(10) Patent No.: US 12,571,200 B1
(45) Date of Patent: Mar. 10, 2026

(54) MODULAR AND RECONFIGURABLE BUILDING STRUCTURES

(71) Applicant: James Kasper Enterprises, LLC, Vancouver, WA (US)

(72) Inventors: James Mark Kasper, Vancouver, WA (US); David Geoffrey Turner, Vancouver, WA (US)

( * ) Notice: Subject to any disclaimer, the term of this patent is extended or adjusted under 35 U.S.C. 154(b) by 0 days.

(21) Appl. No.: 19/203,905

(22) Filed: May 9, 2025

(51) Int. Cl.
*E04B 1/344* (2006.01)
*E04B 1/343* (2006.01)

(52) U.S. Cl.
CPC ..... *E04B 1/3444* (2013.01); *E04B 1/3431* (2013.01)

(58) Field of Classification Search
CPC .. E04B 1/3444; E04B 1/3431; E04B 1/34331; E04B 1/3448
See application file for complete search history.

(56) References Cited

U.S. PATENT DOCUMENTS 3,300,914 A * 1/1967 Stewart ..... E04B 1/3444 296/172
5,237,782 A * 8/1993 Cooper ..... B60P 3/34 296/171
10,400,439 B2 * 9/2019 Lim ..... E04B 1/3483
2005/0055891 A1 * 3/2005 Kuebler ..... E04B 1/3431 52/79.1
2005/0284035 A1 * 12/2005 DeOvando ..... E04B 1/3431 52/79.1
2010/0304658 A1 * 12/2010 Grcevic ..... B60P 3/005 454/187
2011/0023381 A1 * 2/2011 Weber ..... E04B 1/3431 52/79.5
2011/0107717 A1 * 5/2011 Medley ..... E04B 1/3444 52/745.02
2011/0308173 A1 * 12/2011 Forsland ..... E04B 1/0046 52/67
2012/0247034 A1 * 10/2012 Wystup ..... E04H 3/165 52/65
2012/0261407 A1 * 10/2012 Cross ..... E04B 1/3431 29/401.1
2014/0000183 A1 * 1/2014 Perren ..... E04B 1/34869 52/79.5
2015/0315776 A1 * 11/2015 Duncan ..... E04B 1/3444 52/66
2020/0224406 A1 * 7/2020 Brezan ..... E04H 1/1205

FOREIGN PATENT DOCUMENTS

FR 976190 A * 3/1951
WO WO-2018146185 A1 * 8/2018 ..... E04B 1/3483

* cited by examiner

*Primary Examiner* — Christine T Cajilig
(74) *Attorney, Agent, or Firm* — Klarquist Sparkman, LLP

(57) ABSTRACT

A modular and reconfigurable building structure designed to enhance resilience against severe weather and environmental challenges. The system includes a central structure anchored to a foundation, providing stability and defining a primary living space. Movable building units are coupled to the central structure and configured to transition between a deployed configuration, expanding the building footprint, and a collapsed configuration, reducing the footprint for increased protection. The movable units can include pivotable structures and/or retractable structures. One or more folding wall panels connected by hinges can be provided as well as support elements and locking mechanisms to ensure stability during deployment.

20 Claims, 16 Drawing Sheets

MODULAR AND RECONFIGURABLE BUILDING STRUCTURES

FIELD

The present disclosure pertains to modular building systems, specifically to reconfigurable structures incorporating a fixed central structure and deployable secondary components for adaptable building applications.

BACKGROUND

In recent years, the frequency and intensity of extreme weather events have been on the rise, driven by a combination of climate change and evolving environmental conditions. Hurricanes, tornadoes, wildfires, floods, and other natural disasters are occurring with greater regularity, posing significant risks to human life, property, and infrastructure. These events not only threaten the safety of building occupants but also result in substantial economic losses and long-term disruptions to communities. As a result, there is an increasing need for innovative architectural solutions that can provide enhanced protection against these growing threats.

Traditional building designs are ill-equipped to withstand the dynamic forces associated with extreme weather events. High winds, for example, can exert significant pressure on conventional structures, leading to structural failures and catastrophic damage. Similarly, wildfires can rapidly spread through traditional building materials, compromising the integrity of the structure and endangering occupants. Flooding and other environmental stressors further exacerbate the vulnerabilities of conventional designs, highlighting the urgent need for more resilient and adaptable building systems.

The increasing variety and unpredictability of extreme weather events demand a shift in how buildings are designed and constructed. Modern structures must not only provide shelter but also actively mitigate the risks posed by these events. This includes the ability to withstand high winds, resist fire, and adapt to changing environmental conditions. The novel modular structures described herein address these deficiencies by incorporating advanced features that enhance security, safety, and structural integrity during adverse weather and environmental events.

SUMMARY

The present disclosure pertains to various modular building systems that include reconfigurable structures based on a central structure and moveable secondary components, such as movable or slidable building units.

In one embodiment, the disclosure includes a modular building structure comprising a central structure anchored to a foundation and having a plurality of walls that define a first living space, together with one or more movable building units moveably coupled to the central structure. Each movable building unit has a plurality of walls defining a secondary living space and is configured to transition between a deployed configuration and a collapsed configuration. In the deployed configuration, the modular building structure defines a first building footprint of a first size, while in the collapsed configuration the modular building structure defines a second, smaller building footprint, and the movable building unit covers at least a portion of one or more of the walls of the central structure. Additional features include embodiments where a slidable building unit extends outward from the central structure in the deployed configuration and retracts into the central structure in the collapsed configuration, support elements secure and stabilize the movable unit when deployed, folding wall panels pivotably secured by hinges form portions of the movable unit, casters on a lower surface facilitate movement, locking mechanisms secure the movable unit in place, a roof structure is fixedly mounted to the central structure (and in some embodiments mounted to free-standing support structures), and the movable building unit may be formed from a modified shipping container.

In another embodiment, the disclosure includes a method of constructing a modular reconfigurable building structure. The method comprises providing a foundation and securing a central structure to that foundation, the central structure having walls that define a first living space. One or more movable building units, each having walls that define a corresponding secondary living space, are moveably coupled to the central structure and are configured to move between a deployed configuration and a collapsed configuration. In the deployed configuration, the building structure defines a building footprint of a first size, and in the collapsed configuration the footprint is reduced to a second, smaller size. The method further includes coupling a slidable building unit to the central structure such that the slidable building unit extends outward in the deployed configuration and retracts into the central structure in the collapsed configuration, anchoring support elements to stabilize the movable unit, pivotably coupling folding wall panels via building hinges and wall panel hinges, and providing casters on a lower surface of a movable unit to facilitate movement. The method may also include installing a fixed roof structure to the central structure and mounting the roof structure to one or more free-standing support structures, as well as forming the movable building unit from a modified shipping container.

In yet another embodiment, the disclosure includes a method of deploying and collapsing a modular building structure. The method comprises moving one or more movable building units coupled to a central structure from a deployed configuration, in which the movable units extend outward to form an expanded building footprint defining increased living space, to a collapsed configuration, wherein at least some of the movable units are arranged adjacent to the central structure. The method further comprises engaging one or more locking mechanisms to secure the movable units in the collapsed configuration. In some embodiments, movement of the movable building units is accomplished by operating a motor coupled to the units, while in other embodiments the movable units are pivoted about hinge members and/or retracted into an interior space of the central structure.

The foregoing and other objects, features, and advantages of the disclosed technology will become more apparent from the following detailed description, which proceeds with reference to the accompanying figures.

DETAILED DESCRIPTION

Explanation of Terms

Figure 1:
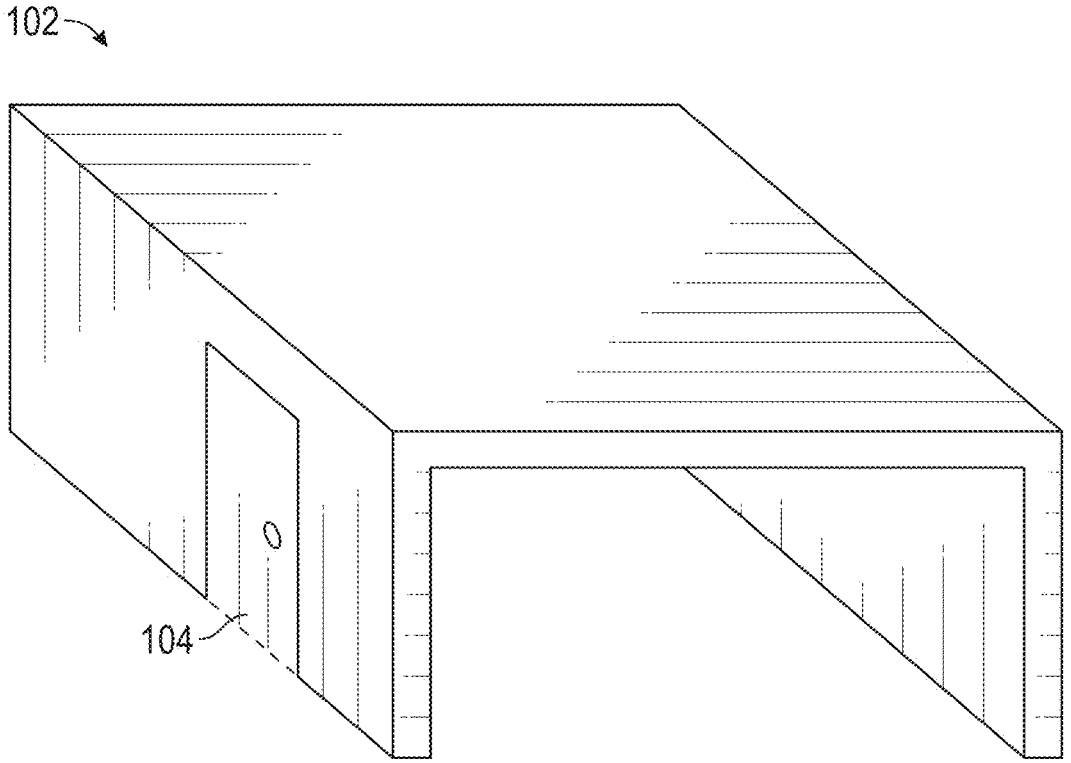
FIG. 1 is a perspective view illustrating the reinforced central structure with integrated access features.
Figure 2:
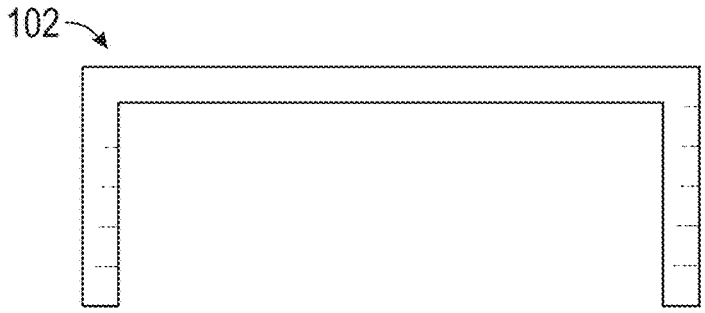
FIG. 2 illustrates a schematic diagram of the central structure forming the spine of the system.
Figure 3:
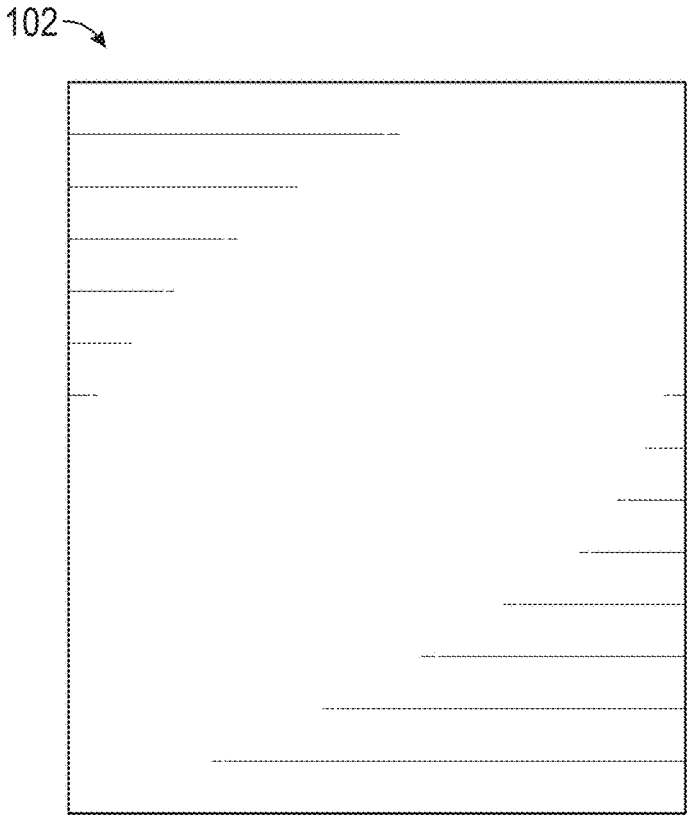
FIG. 3 illustrates a schematic diagram of the central structure forming the spine of the system.
Figure 4:
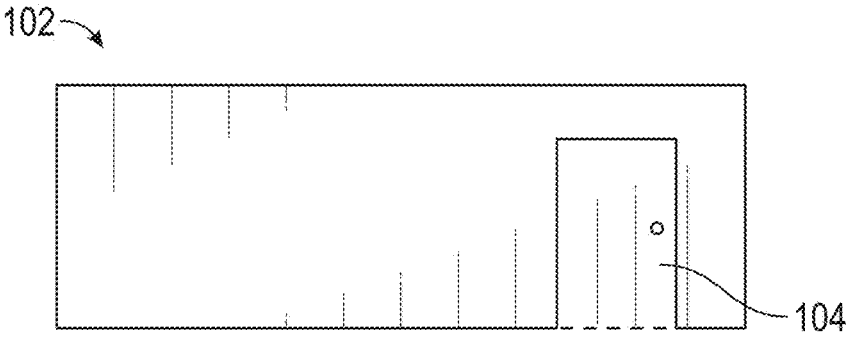
FIG. 4 illustrates a schematic diagram of the central structure forming the spine of the system.
Figure 5:
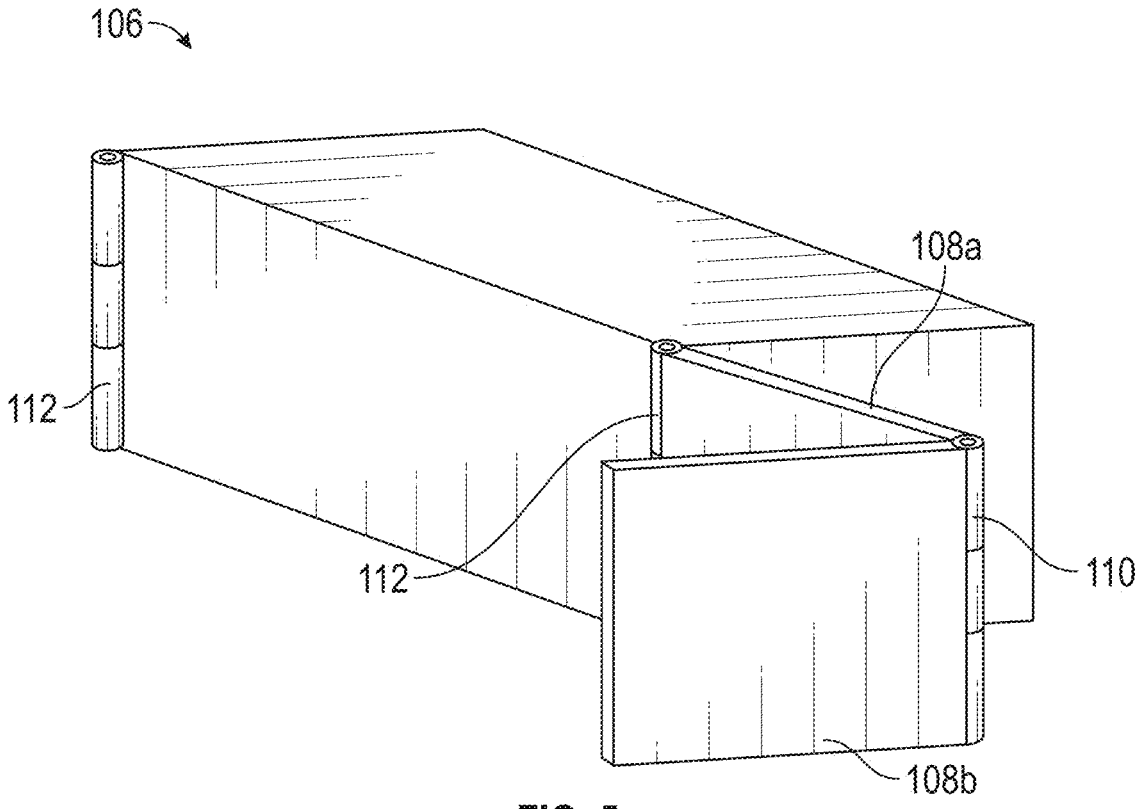
FIG. 5 illustrates a perspective view of a movable building unit with folding wall panels in a partially deployed configuration.
Figure 6:
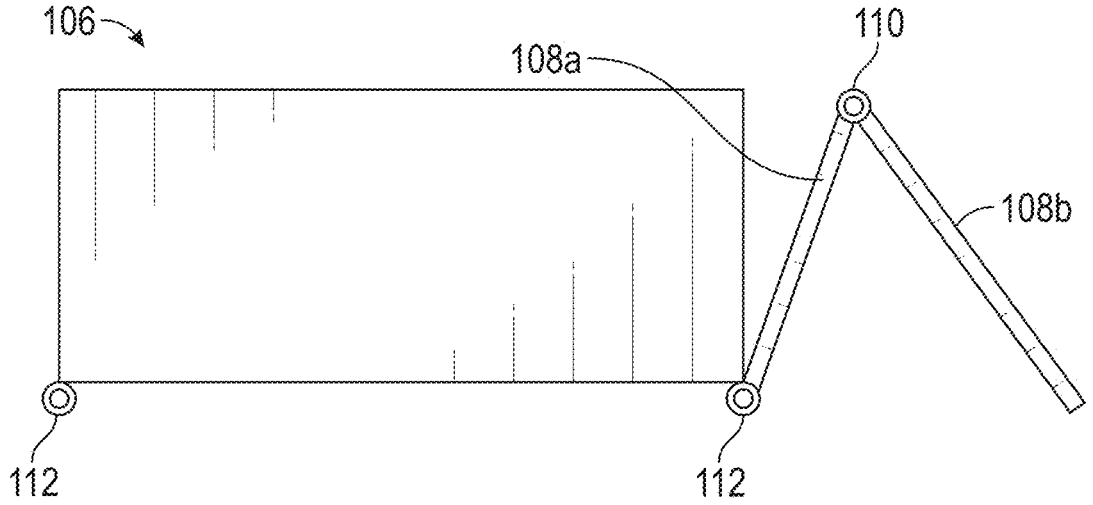
FIG. 6 illustrates a top view of a movable building unit with folding wall panels in a partially deployed configuration.

For purposes of this description, certain aspects, advantages, and novel features of the embodiments of this disclosure are described herein. The disclosed methods, apparatus, and systems should not be construed as being limiting in any way. Instead, the present disclosure is directed toward all novel and nonobvious features and aspects of the various disclosed embodiments, alone and in various combinations and sub-combinations with one another. The methods, apparatus, and systems are not limited to any specific aspect or feature or combination thereof, nor do the disclosed embodiments require that any one or more specific advantages be present or problems be solved.

Although the operations of some of the disclosed embodiments are described in a particular, sequential order for convenient presentation, it should be understood that this manner of description encompasses rearrangement, unless a particular ordering is required by specific language set forth herein. For example, operations described sequentially may in some cases be rearranged or performed concurrently. Moreover, for the sake of simplicity, the attached figures may not show the various ways in which the disclosed methods can be used in conjunction with other methods.

As used in this disclosure and in the claims, the singular forms "a," "an," and "the" include the plural forms unless the context clearly dictates otherwise. Additionally, the term "includes" means "comprises." Further, the terms "coupled" and "associated" do not exclude the presence of intermediate elements between the coupled or associated items absent specific contrary language.

Although there are alternatives for various components, dimensions, parameters, operating conditions, etc., set forth herein, that does not mean that those alternatives are necessarily equivalent and/or perform equally well. Nor does it mean that the alternatives are listed in a preferred order unless stated otherwise.

As used herein, the term "living space" refers to an area substantially enclosed by a structure that is designed and intended for human occupancy and use. It may be a covered or uncovered, so long as it is substantially enclosed by the structure. By substantially enclosed, it means that along a perimeter, any continuous unenclosed portion (i.e., an area that is not capable of being closed) is less than 10 feet. The living space includes, for example, rooms or sections such as bedrooms, living rooms, kitchens, and other areas where individuals can reside, work, or engage in daily activities. The term "primary living space" refers to a living space in a collapsed configuration and the term "secondary living space" refers to an additional enclosed living space (i.e., in addition to the primary living space) that is available and/or defined when the structure is an expanded configuration.

As used herein, the term "building footprint," refers to the outermost boundary or perimeter that defines the dimensions of a rectangle encompassing the entire footprint of a building that includes the living space, excluding free-standing support structures. It represents the maximum horizontal and vertical extent of the structure and is used to describe the overall size or spatial coverage of the building's base area.

As used herein, an "area" of the living space is a measurement of a distance squared (e.g., square feet (sq ft) or square meters (sq m). Similarly, an "area" of the building footprint is a measurement of a distance squared for the building footprint.

As used herein, the term "fixedly mounted" refers to the secure attachment of an object or component to another structure in a manner that prevents movement or displacement from one another under normal operating conditions. This type of mounting ensures stability and permanence, typically achieved through the use of fasteners, adhesives, welding, or other rigid connection methods.

As used herein the term "slidable" refers to an object moving horizontally relative to the ground. Such movement may include any manner of moving horizontally, such as by moving on a surface or track facilitated by wheels, casters, rollers, low-friction materials, etc.

Overview of the Disclosed Technology

The construction and design of building structures have long been a significant area of focus in architecture and engineering. Traditional building systems are often developed to provide static, rigid configurations that emphasize stability under typical circumstances. However, these systems often fall short in addressing the dynamic challenges posed by severe environmental conditions, such as hurricanes, tornadoes, wildfires, and other natural disasters. The lack of adaptability to such conditions can lead to substantial structural failures, posing risks to occupants and causing extensive property damage. These limitations highlight the need for innovative solutions that can dynamically respond to environmental threats while maintaining structural integrity.

The present system addresses these deficiencies by introducing a modular and reconfigurable building approach that incorporates advanced features to enhance resilience and adaptability. At the center of the system is a reinforced central structure that provides significant stability and strength under challenging conditions. Surrounding this central structure (or spine) are modular units, or pods, that can be reconfigured or collapsed inward to create a compact and protected form during high-risk scenarios. When collapsed inward, this design minimizes exposure to external forces, such as strong winds, reducing the likelihood of structural damage.

In some embodiment, in addition to demonstrating adaptability, the described system employs materials and design elements tailored for fire resistance, ensuring that structural components remain intact and the spread of flames is reduced. The incorporation of folding panels, slidable units, and secure locking mechanisms further improves the system's capacity to respond to changing conditions, providing a transformative approach for creating safer, more secure environments designed to endure challenges posed by severe weather and environmental events.

Embodiments of the Disclosed Technology

FIGS. 1-4 show various views of a central structure 102 (also sometimes referred to herein as the "spine"). The central structure 102 serves as the reinforced foundational element of the modular building system, providing stability and strength to the overall structure.

The central structure 102 is designed to function as the main load-bearing component of the modular system. The central structure 102 serves as the anchoring point for other modular components, such as movable building units 106, which can be attached or reconfigured based on requirements. The central structure, alone or in combination with other supports, can also support a roof structure that extends over living spaces outside of the living space of the central structure (e.g., secondary living spaces). The central structure 102 can also have conventional components, such as a door 104 to provide access to the interior of the structure and/or windows.

The central structure 102 can be secured to the ground through a foundation. That is, the foundation is anchored to the ground and the central structure is anchored to the foundation. Depending on regional environmental conditions, the anchoring of both structures can be reinforced. For example, the foundation can be anchored to the ground in a conventional manner and/or additional measures can be taken, such as installing piles (e.g., steel, concrete, or timber) deep into the ground to transfer the load from the structure to deeper, more stable layers in the ground. Similarly, the central structure can be secured to the foundation in a conventional manner (e.g., anchor bolts and concrete footings) and/or these measures can be reinforced if desired.

FIGS. 5-7B illustrate a movable building unit 106. As described below, the movable building unit 106 can be moveably secured to the central structure 102. The movable building unit 106 can be equipped with one or more panels and one or more hinges, e.g., a first folding wall panel 108*a* and a second folding wall panel 108*b*, which are connected via a wall panel hinge 110.

The wall panel hinge 110 allows the two folding wall panels to move relative to one another and, in the deployed configuration allows the mobile building unit 106 to move away from the central structure 102. In the collapsed configuration; however, the wall panel hinge 110 allows the two folding wall panels to collapse and stack adjacent to one another so that the mobile building unit 106 is adjacent the central structure 102.

Figure 7A:
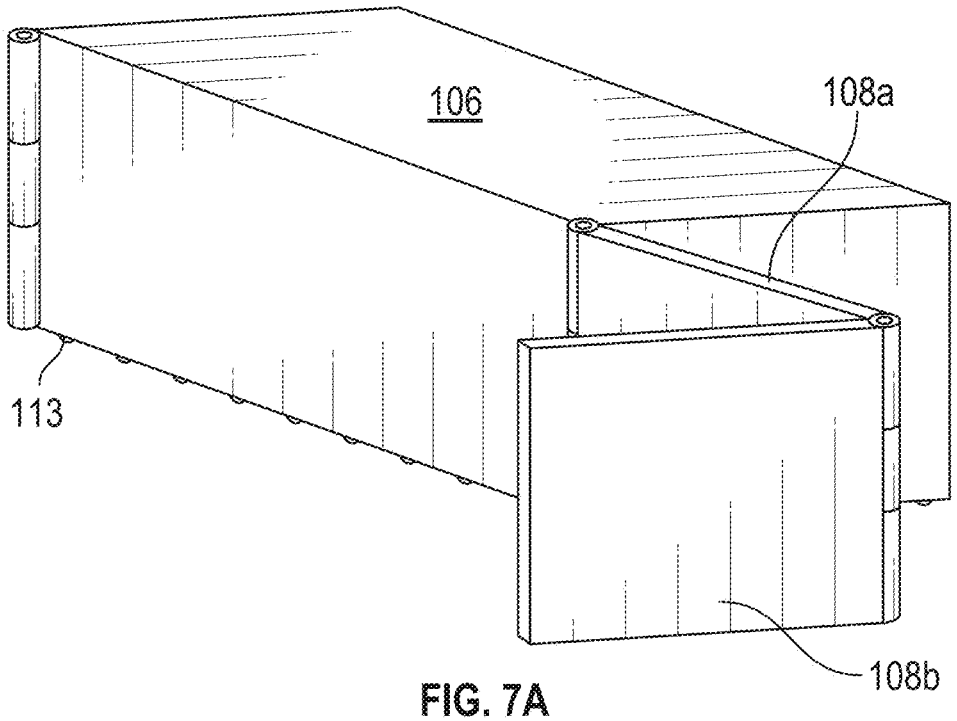
FIG. 7A is a perspective view illustrating a movable building unit with folding wall panels in a partially deployed configuration.
Figure 7B:
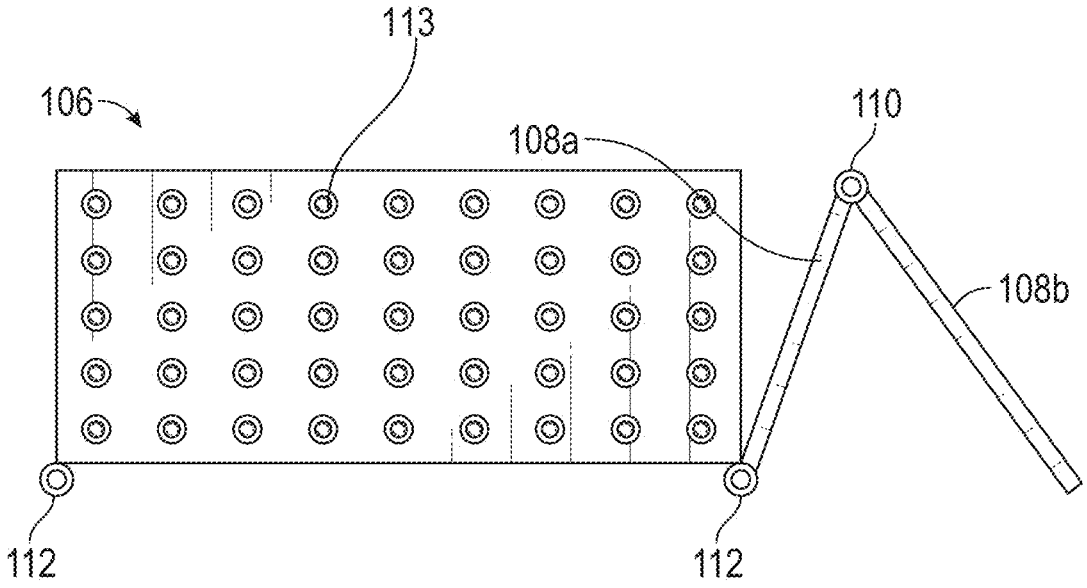
FIG. 7B is a bottom view depicting the movable building unit with a plurality of casters to facilitate movement between configurations.

As described below, the movable building unit 106 can be moved across a surface between two or more configurations. As shown in FIGS. 7A and 7B, to facilitate this movement along a surface (e.g., a foundation surface and/or ground surface), in some examples, the movable building unit can be supported by casters 113 on the lower surface of the movable building unit 106, enabling mobility and ease of deployment. In addition to, or instead of, casters, other structures can be used to facilitate the movement of the movable building unit 106 and other modular components described herein. For example, any combination of wheels, casters, rollers, skid plates, and/or tracks on the ground or bottom of the movable building unit can be used to reduce friction and facilitate movement of the movable building units 106.

Figure 8:
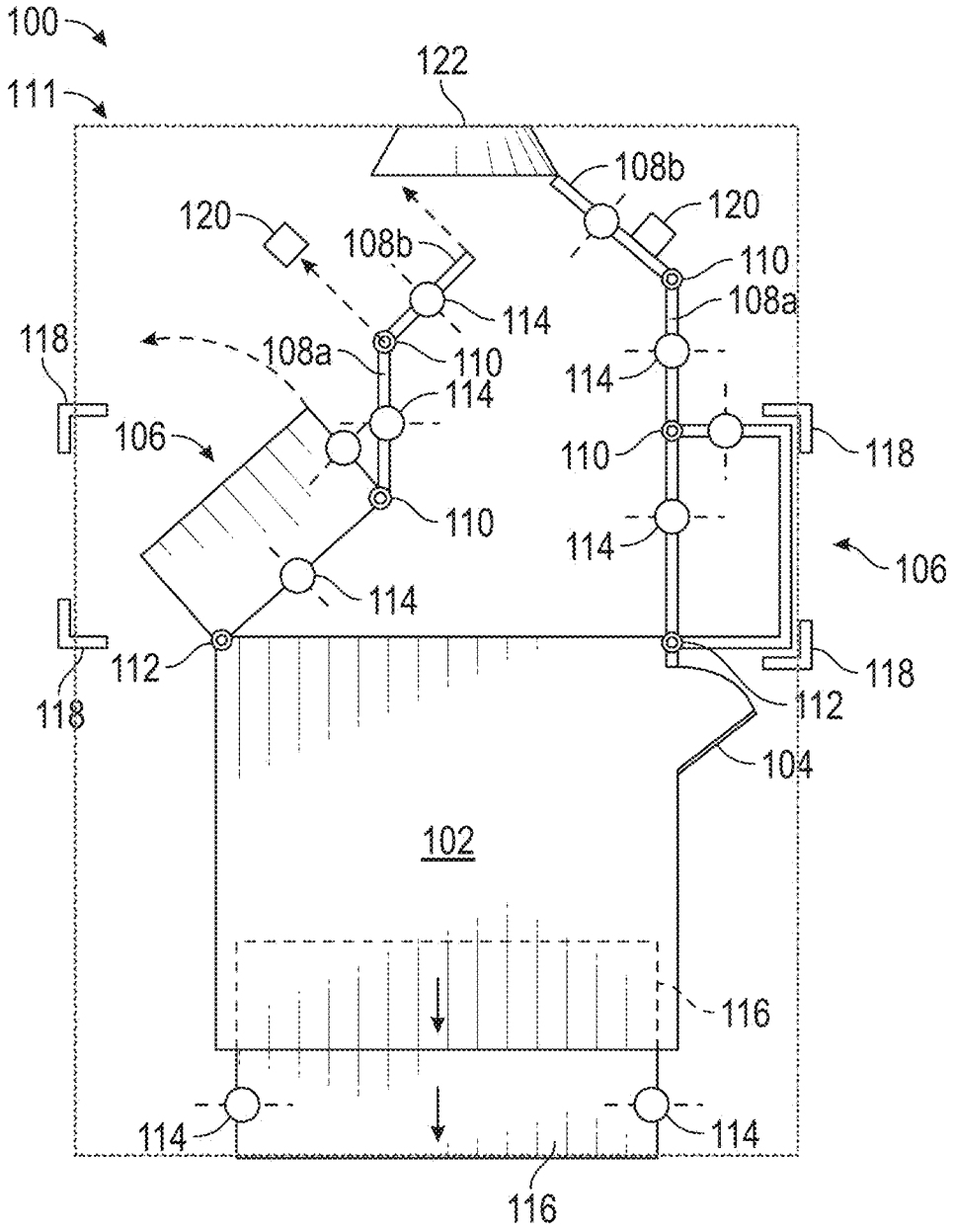
FIG. 8 is a schematic diagram illustrating a modular building structure with deployable and foldable components.

FIG. 8 illustrates a modular building structure 100, which incorporates a central structure 102, movable building units 106, folding wall panels 108, slidable building units 116, and various supporting components such as wall panel hinges 110, movable building unit hinges 112, building unit supports 118, wall panel supports 120, and a connecting support 122. The modular building structure 100 is designed to provide a reconfigurable and adaptable architectural solution for enhanced resilience against environmental challenges.

As shown in FIG. 8, the movable building units 106 are attached to the central structure 102 via hinges 112. In this embodiment, the movable building units 106 are equipped with folding wall panels 108, which include a first folding wall panel 108*a* and a second folding wall panel 108*b*. The folding wall panels 108 are connected by wall panel hinges 110, allowing them to fold and collapse (e.g., for compact storage) or deploy outward to expand the footprint and usable space of the modular building structure 100.

The movable building structure can also include one or more slidable building units. For example, slidable building unit 116 can slide along a surface to adjust its position relative to the central structure 102. In a deployed configuration, slidable building unit 116 is extended outward from the central structure 102 to increase available living space in the modular building structure 100. In a collapsed configuration, slidable building unit 116 can be retracted into modular building structure 100 by sliding along (or above) a surface using, for example, any combination of wheels, casters, rollers, skid plates, and/or tracks to facilitate that movement.

The folding wall panels 108 can also be supported by one or more free-standing wall panel supports 120, which enhance their structural stability when deployed. It should be understood that the term free-standing means that the support can be separated from the wall panels or building unit. Thus, for example, when deployed, the supports may be coupled to the component but when collapsed the supports become free-standing and are separated from the components.

The wall panel supports 120 ensure that the folding wall panels 108 remain securely in place when deployed. Another free-standing structure, e.g., a connecting support 122, can be provided to link up various components of the modular building structure 100, such as two wall panels.

The supporting components of the modular building structure, including wall panel supports, building unit supports, and connecting supports, can be constructed from a variety of materials and structural designs to ensure durability, stability, and adaptability. In some examples, these supports can be selected from materials that are intended to survive a serious environmental event; however, they can also be selected from materials that are not intended to survive since replacing the exposed supports may be relatively low cost. For example, a wood support may be destroyed during a fire event, but could relatively easily be replaced.

Building unit supports 118 are used to anchor and stabilize movable building units when they are in the deployed configuration. These supports can include heavy-duty posts or beams made from steel, concrete, or engineered wood. Steel supports, such as I-beams or angle iron, may be particularly effective for high-load applications and environments requiring enhanced resilience against normal environmental conditions (e.g., high wind areas). Concrete supports, such as precast columns or reinforced blocks, provide excellent stability and resistance to environmental conditions. In some cases, hybrid supports combining metal and concrete elements may be used to optimize strength and durability.

Wall panel supports 120 are designed to stabilize folding wall panels when they are deployed, ensuring that the panels remain securely in place during normal environmental conditions in a deployed configuration. These supports can take the form of vertical posts made from materials such as steel, aluminum, wood, or reinforced concrete. Metal posts, such as those constructed from angle iron or tubular steel, provide high strength and resistance to bending or deformation. Wooden posts, treated for weather resistance, offer a cost-effective and lightweight alternative. In some embodiments, adjustable or telescoping supports may be used to accommodate varying panel heights or configurations.

Connecting supports 122 are used to link various components of the modular building structure, such as two separate folding wall panels as shown in FIG. 8. These supports can include horizontal beams, brackets, or frames made from steel, aluminum, or other high-strength materials. In some embodiments, connecting supports may include adjustable or pivoting mechanisms to accommodate for movement and reconfiguration of the modular units. Additionally, connecting supports may be designed with integrated fasteners, such as bolts or clamps, to ensure secure and reliable connections. Additionally, the connecting supports may include an egress point (e.g., a door) centrally located in the connecting support to allow access into and out of the area enclosed by the connecting support.

Unlike the movable portions of the system, the supports 118, 120, 122 are securely anchored to the ground using concrete footings or similar foundational methods. Concrete footings provide a stable base by distributing the load of the supports across a larger area, reducing the risk of sinking or shifting under environmental stressors such as high winds, flooding, or seismic activity. The footings can be reinforced with steel rebar to enhance their strength and durability, ensuring they can withstand heavy loads and dynamic forces.

For vertical supports, such as posts or beams, the base of the support can be embedded into the concrete footing or attached using anchor bolts, which are secured into the concrete. This method prevents lateral movement and ensures a rigid connection between the support and the ground.

By employing these anchoring techniques, the modular building structure's freestanding supports are able to maintain their position and functionality during deployment and reconfiguration, while also enhancing the overall resilience of the structure when in the deployed configuration. Also, securely securing the supports ensures that they do not come free and strike the main structure when in the collapsed configuration.

Referring to FIG. 8, the right side of modular building structure 100 illustrates a fully-deployed movable building unit 106 and the left side illustrates a partially-deployed movable building unit 106. The arrows on the left side indicate the direction in which the movable building unit 106 is moving toward full deployment.

Figure 9:
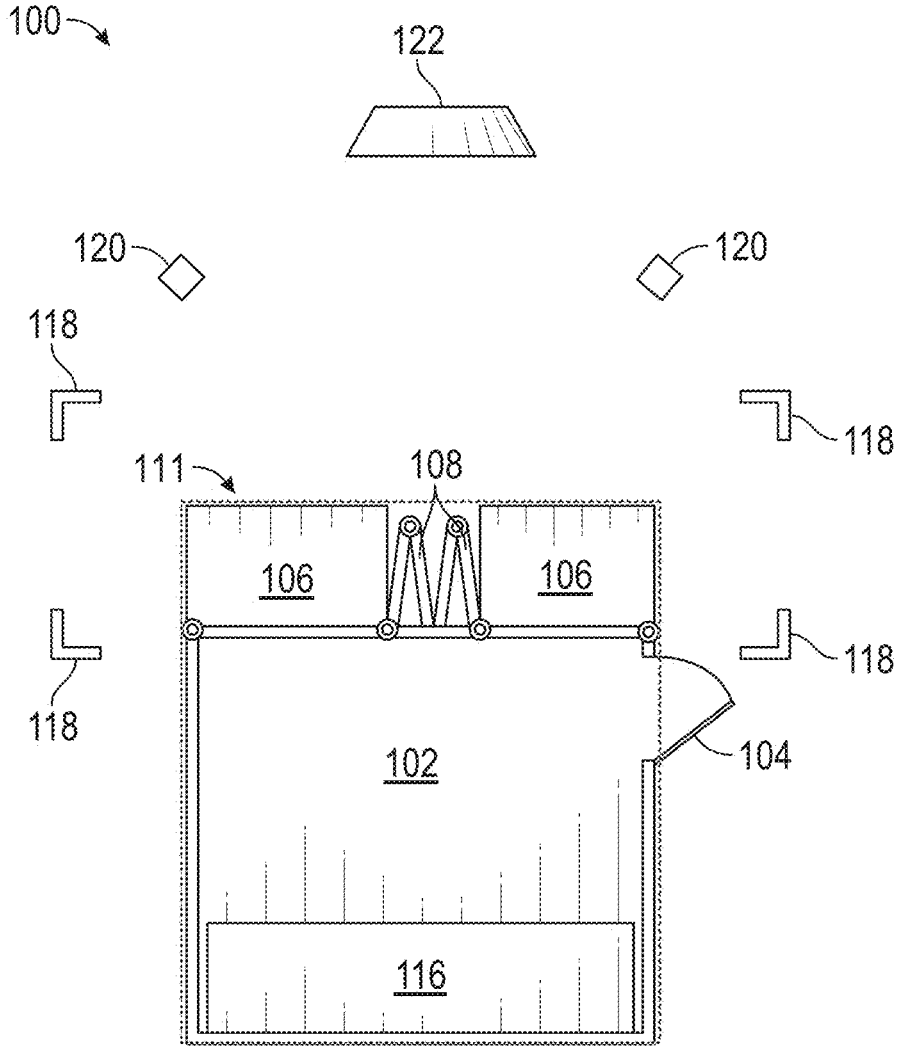
FIG. 9 illustrates a modular building structure with a central spine supporting movable units and folding panels, shown in a collapsed configuration.

FIG. 9 illustrates the same modular building structure 100 in a collapsed configuration. In particular, modular building units 106 have been moved back to be adjacent to central structure 102 and the folding wall panels are in a folded configuration (i.e., folded back to back with each other). In addition, slidable building unit 116 has been retracted into the central structure. In the collapsed configuration, the components are arranged to provide a compact and secure structure for enhanced resilience against environmental challenges.

Dashed lines 111 in FIGS. 8 and 9 illustrate an outermost boundary or perimeter that defines the dimensions of a rectangle encompassing the entire footprint of the buildings in the different configurations. It represents the maximum horizontal and vertical extent of the structures. In the expanded configuration, it includes structures like wall panels if they expand and define an interior living space (i.e., including the living spaces in the buildings and an expanded living space between buildings as defined by the wall panels). In FIG. 9, however, the footprint excludes the freestanding supports since those supports, in this configuration, do not contribute to the living space. Thus, for example, the footprint of an expanded configuration can be at least than 10%, at least 20%, at least 30%, or at least 50% larger than the footprint of the collapsed configuration. For example, if the collapsed configuration is 10,000 square feet, the expanded configuration could be 11,000 square feet, 12,000 square feet, 13,000 square feet, 15,000 square feet or greater.

An area of the living space can similarly be expanded. the footprint of an expanded configuration can be at least than 10%, at least 20%, at least 30%, at least 50% larger than the footprint of the collapsed configuration. For example, if the collapsed configuration has an area of a primary living space that is 4,000 square feet, the expanded configuration can have a total area of living space (i.e., primary and secondary) that is 4,400 square feet, 4,800 square feet, 5,200 square feet, 6,000 square feet, or greater.

In each of the above embodiments, in some examples, the maximum expansion can be 200%, 100%, or 80%. Thus, for example, the area of the footprint or living space of an expanded configuration can be between 10% and 200%, 30% and 100%, etc.

In some embodiments, the modular building units 106 can be formed from materials that provide enhanced protection from environmental conditions, such as projectiles during a wind event (e.g., a tornado or hurricane) and/or from high heat such as during a fire event. For example, the wall of central structure 102 that is adjacent to the modular building units 106 is protected from damage by that structure position between the natural event and the central structure 102.

In some embodiments, the modular building units 106 can be formed from a strong rectangular unit, such as a shipping container that has been modified for a building use, or another similar structure.

Figure 10A:
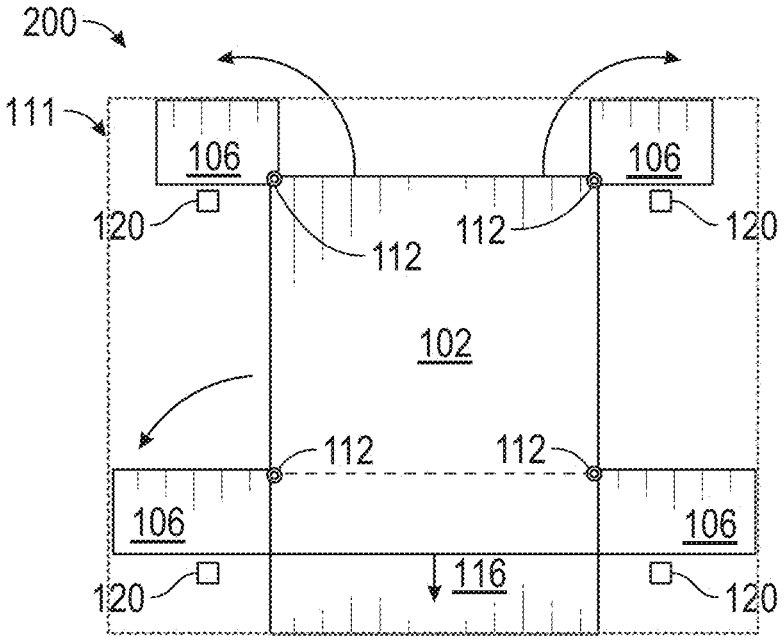
FIG. 10A is a schematic diagram illustrating a central structure with movable building units.

In addition to the deployment configurations shown in FIGS. 8 and 9, other configurations are possible. For example, FIG. 10A illustrates another embodiment in which modular building units 106 are hingedly coupled directly to a central structure 102 without intermediate wall panels. Like the other embodiments, the modular building units 106 can extend between deployed configurations (in which the footprint of the modular building structure is increased) and collapsed configurations (in which the footprint of the modular building structure is decreased).

Figure 10B:
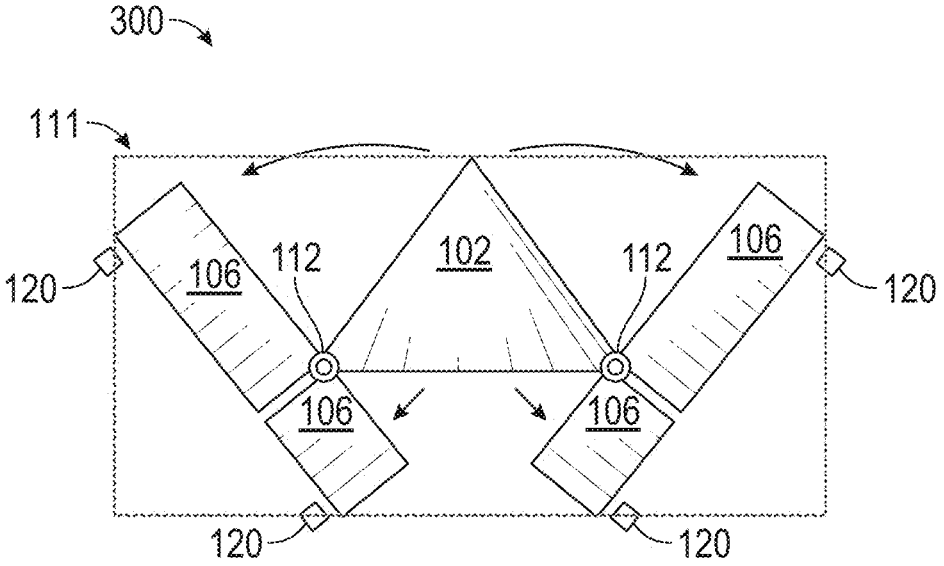
FIG. 10B is a schematic diagram illustrating a central structure with movable building units.

FIG. 10B illustrates another embodiment in which the shape of the central structure 102 varies. Instead of a rectangular structure, the central structure 102 in FIG. 11 has a triangular shape. Of course, any other shapes are possible, so long as the central structure is capable of having one or more modular building units 106 coupled thereto.

FIGS. 10A and 10B also illustrate a building footprint for each of the building structures. The dashed lines 111 show the outermost boundary or perimeter that defines the dimensions of a rectangle encompassing the entire footprint of the buildings 200, 300.

Figure 10C:
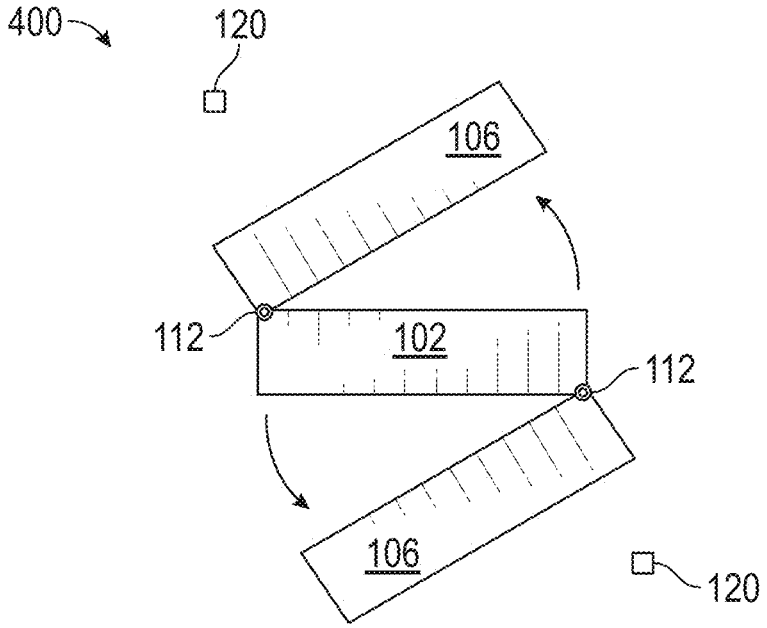
FIG. 10C is a schematic diagram illustrating a central structure with movable building units
Figure 10D:
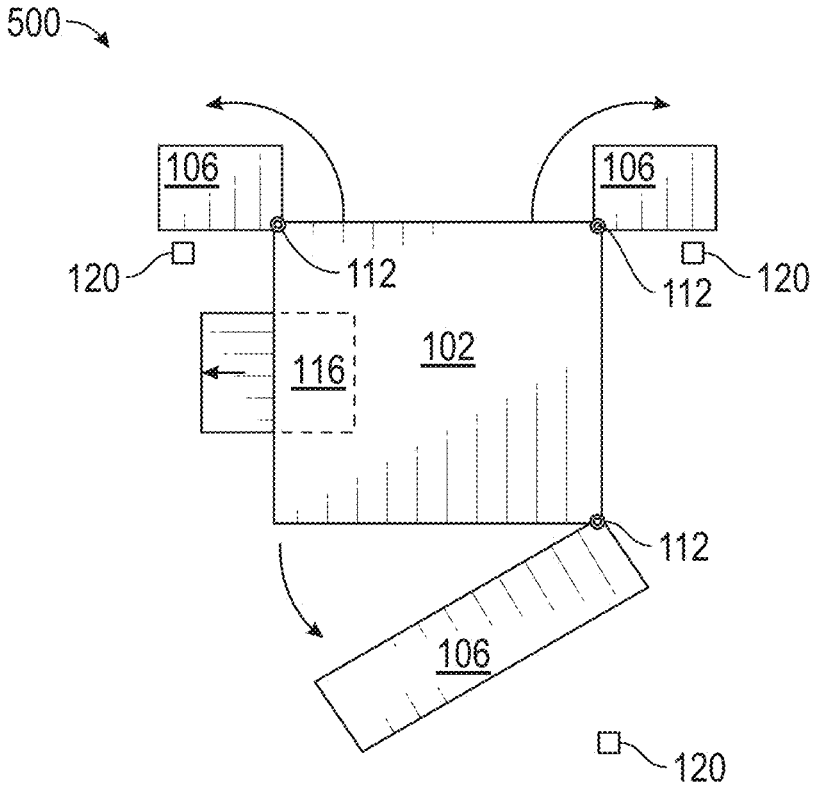
FIG. 10D is a schematic diagram illustrating a central structure with movable building units.

FIGS. 10C and 10D illustrate additional embodiments in which the central structure and modular building units are the same or similar size (e.g., FIG. 10C) and embodiments in which the central structure and modular building units are of various and different sizes (e.g., FIG. 10D).

FIG. 11-15 illustrates a modular building structure 600, which incorporates a central structure 102, a movable building unit 106, a first folding wall panel 108*a*, a second folding wall panel 108*b*, wall panel supports 120, a connecting support 122, a roof structure 124, and a slidable building unit 116. The modular building structure 600 is designed to provide a reconfigurable and adaptable architectural solution for enhanced resilience against environmental challenges.

Figure 11:
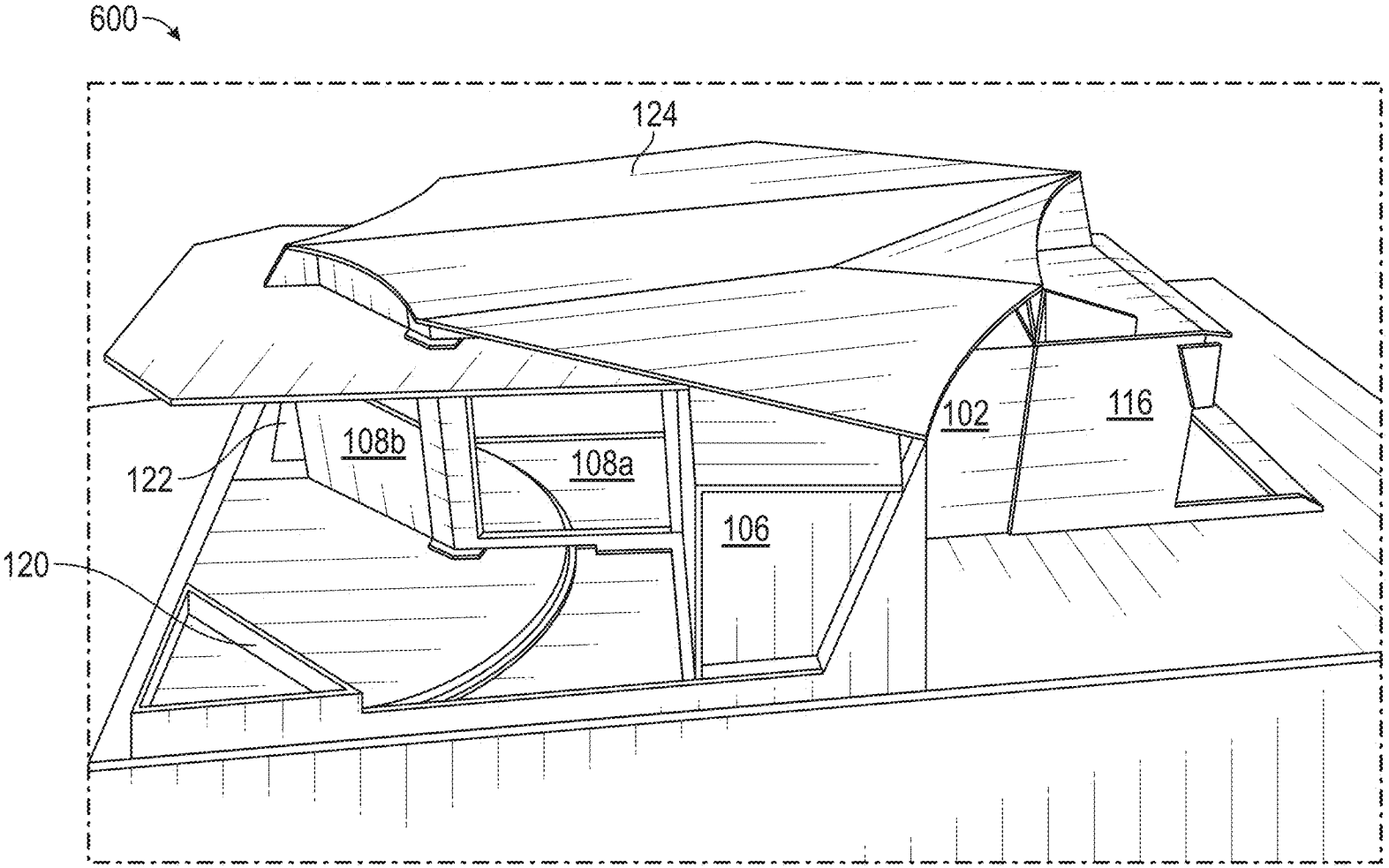
FIG. 11 is a perspective view illustrating the structural configuration of a central structure with movable and folding building units and a central roof structure.
Figure 12:
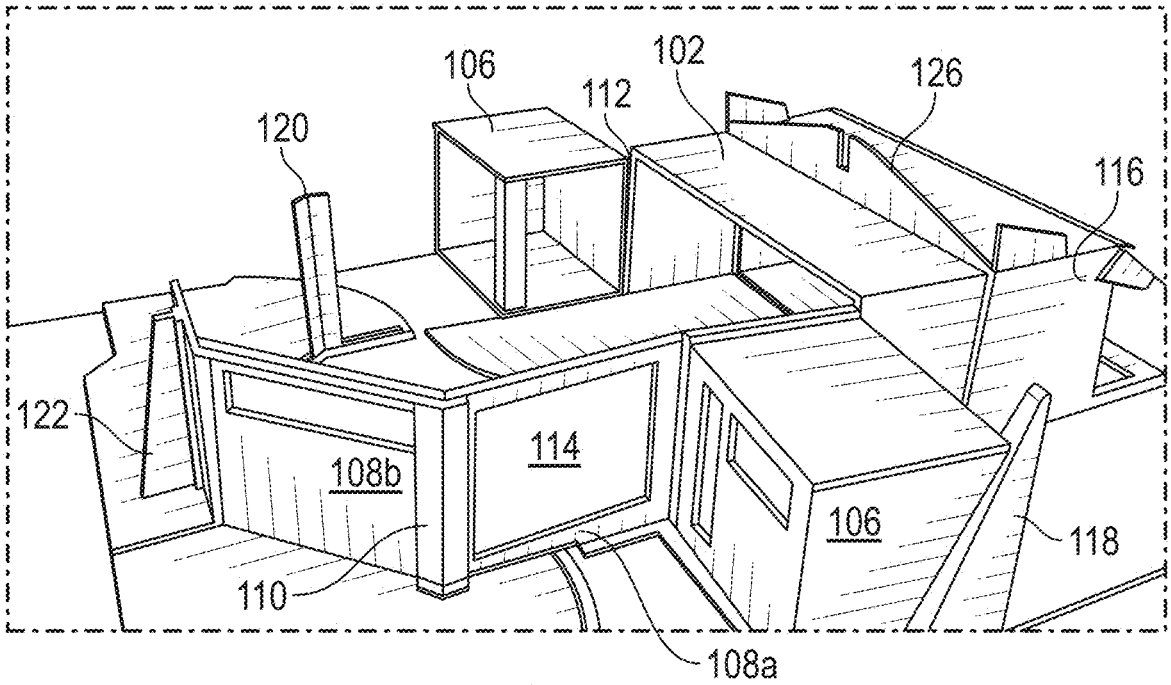
FIG. 12 illustrates a perspective view of the system's central structure and the associated movable building units.
Figure 13:
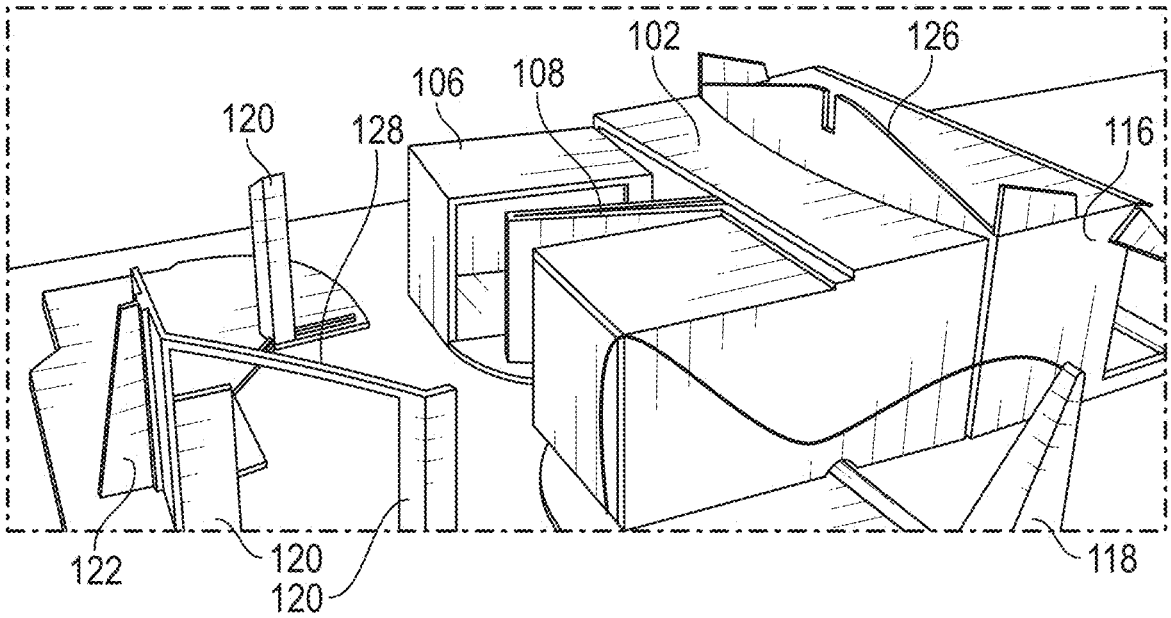
FIG. 13 depicts a perspective view of the system's central structure and movable building units.

FIG. 11 illustrates the modular building structure 600 with the roof structure 124 in place. The central structure 102 serves as the foundational element of the modular building structure 600, providing stability and acting as the primary load-bearing component for roof structure 124. The roof structure 126 can be additionally supported by one or more of the wall panel supports 120 and/or one or more connecting supports 122.

The roof structure 126 can simply be a roof of the central structure, and each of the other structures (e.g., movable building/sliding units) can have their own roofs, either supported by those structures or supported by other structures. In FIG. 11, however, the roof structure 126 extends well beyond the footprint of the central structure to extend over and protect secondary living spaces that are defined in the deployed configuration. Thus, in some embodiments, a central roof structure is provided to cover the central structure as well as secondary (expanded) living spaces.

FIGS. 12-15 illustrate the building structure 600 without the roof structure 126 for clarity. The movable building unit 106 is attached to the central structure 102 and is equipped with folding wall panels, including the first folding wall panel 108*a* and the second folding wall panel 108*b*. These folding wall panels are connected by hinges, allowing them to fold and collapse for compact storage (in a stowed configuration) or deploy outward to expand the usable space of the modular building structure 600 (in a deployed configuration.

The wall panel supports 120 and connecting support 122 provide structural support to the modular building structure 600 by supporting the roof structure 124 and/or by ensuring that the structures that engage with them (e.g., folding wall panels and/or movable building units) remain securely in place during use As described in other configurations, the slidable building unit 116 is configured to slide along a surface (130) to adjust its position relative to the central structure 102. In a deployed configuration (e.g., FIG. 14), the slidable building unit 116 extends outward to increase the available living space, while in a collapsed configuration (e.g., FIG. 15), the slidable building unit 116 retracts to create a compact and secure structure. In some embodiments, the slidable building unit can be fully retracted into the footprint of the central structure. Alternatively, slidable building unit can be retracted partially, e.g., 50%, 75%, or 95% of the slidable building unit can be retracted into the footprint of the central structure.

Figure 14:
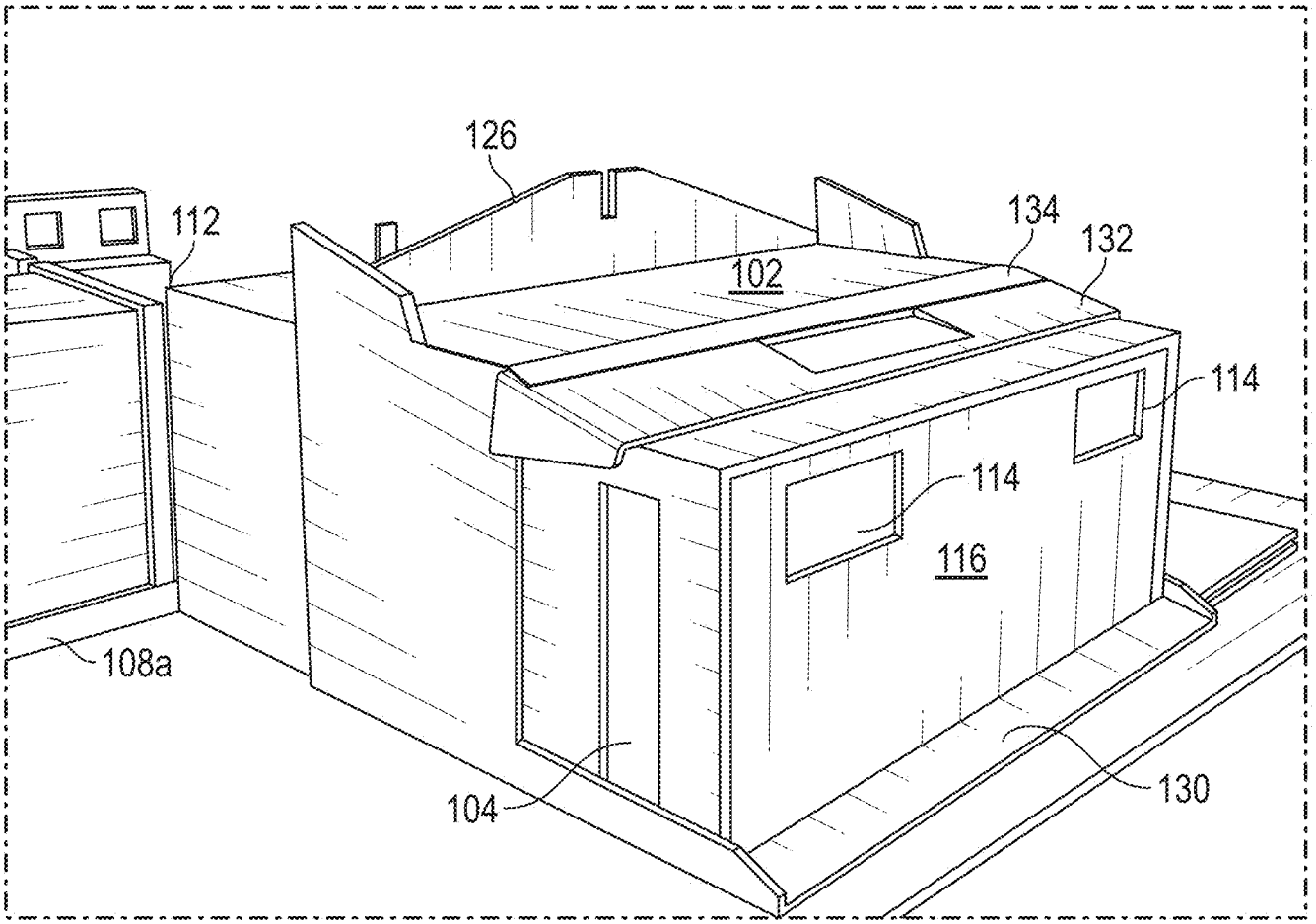
FIG. 14 illustrates a perspective view of the system's central structure and movable building units.
Figure 15:
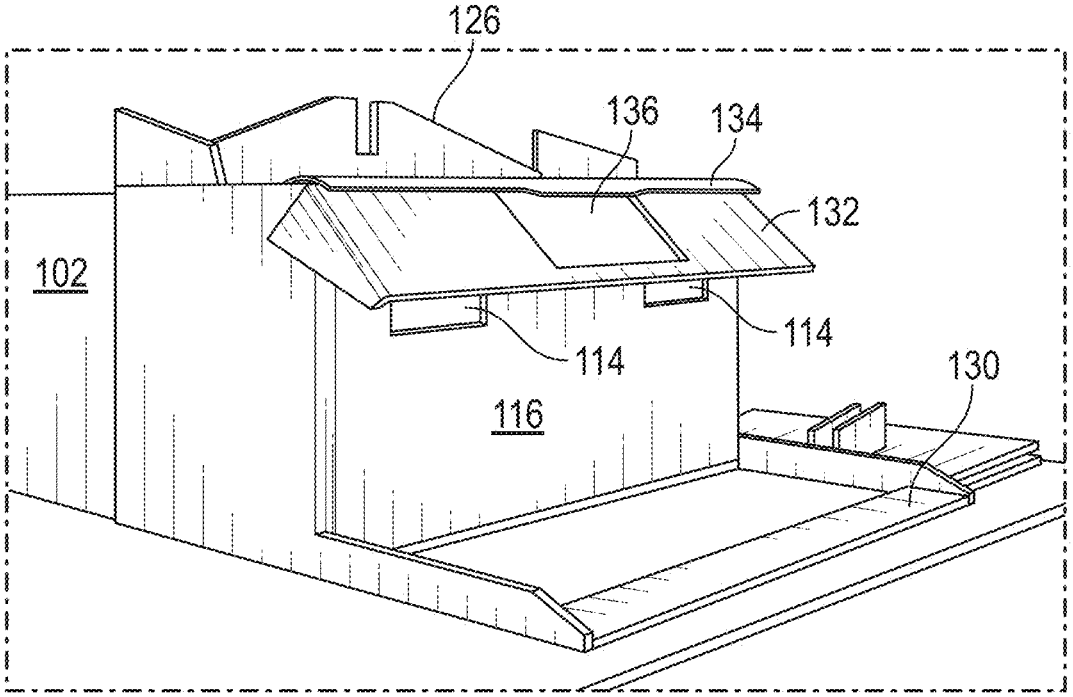
FIG. 15 is a perspective view illustrating a collapsible building structure with slidable and deployable components.

As shown in FIGS. 14 and 15, a collapsible roof portion 132 can be coupled to a collapsible roof hinge 134, thereby allowing the collapsible roof portion 132 to pivot from a first extended position along a roof structure (FIG. 14) to a collapsed configuration along a side wall of the building (e.g., FIG. 15 showing it partially collapsed). In some embodiments, when fully collapsed the collapsible roof portion can cover and protect specific components of the structure (e.g., windows 114 in the slidable building unit). In this manner, the collapsible roof structure can protect the windows from damage when the structure is in the stowed configuration. If desired, a skylight 136 or other feature can be provided in the collapsible roof portion.

Figure 16:
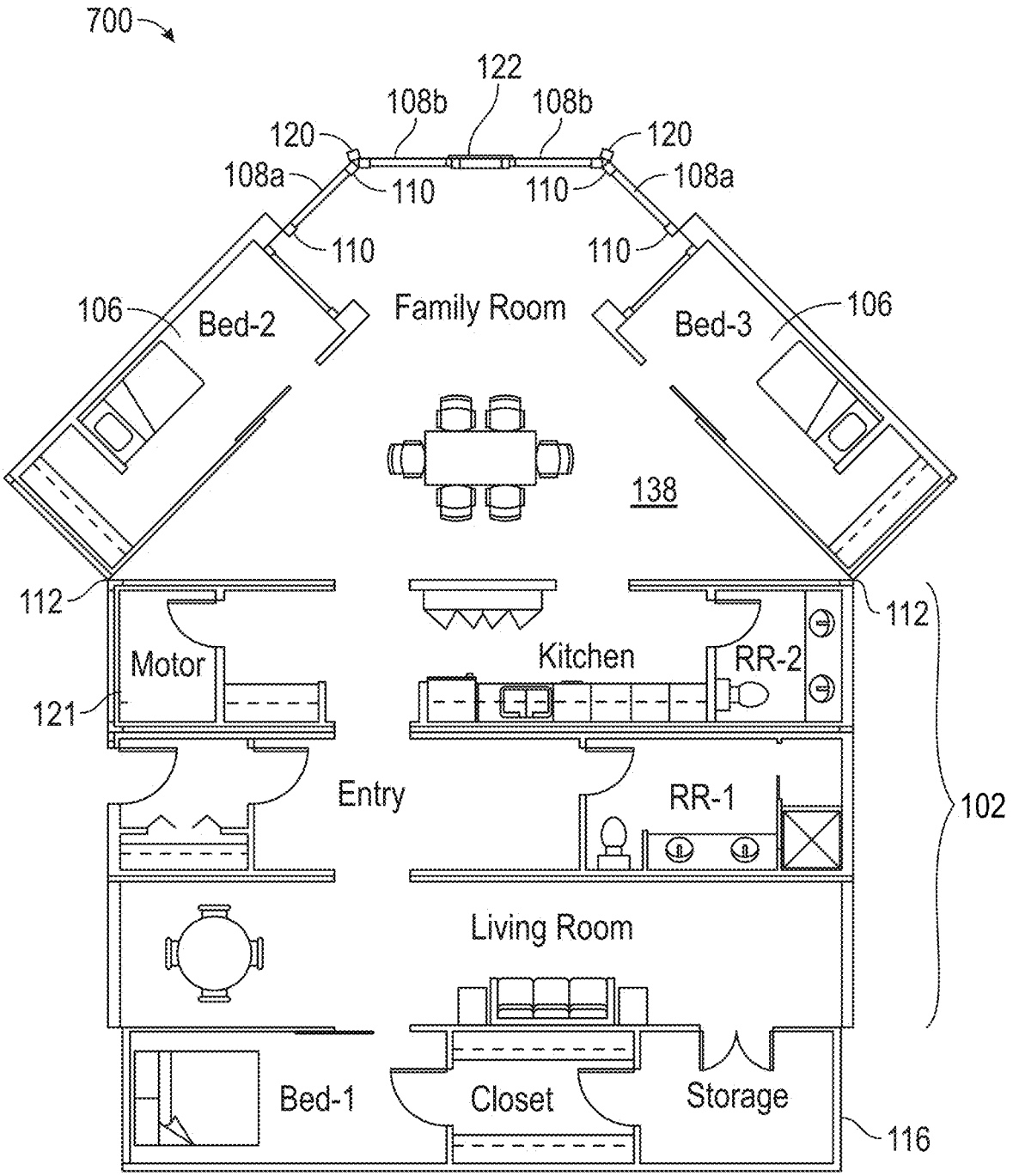
FIG. 16 is a schematic diagram illustrating an expandable building structure with movable and folding components, shown in an expanded configuration.
Figure 17:
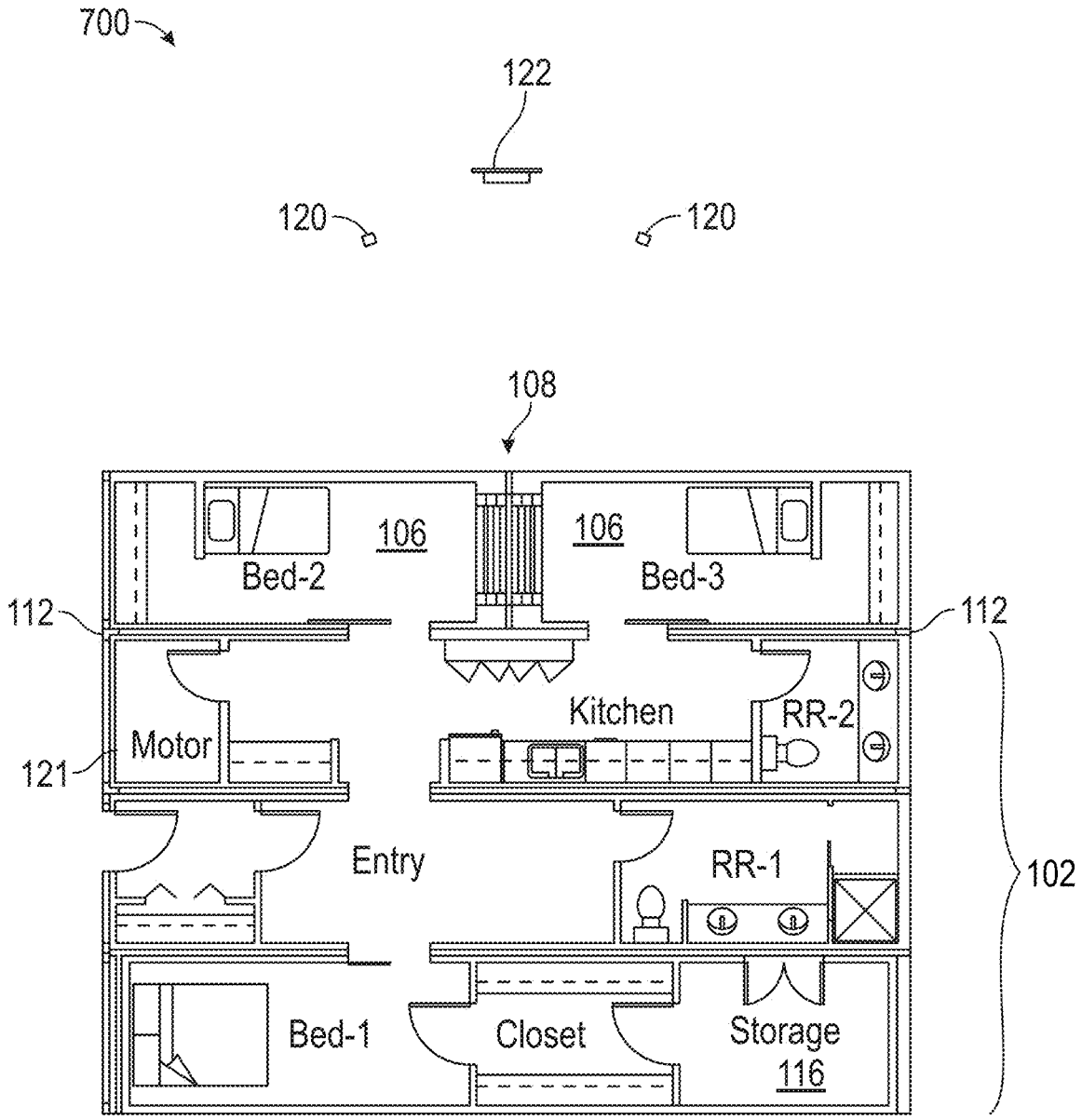
FIG. 17 is a schematic diagram illustrating an expandable building structure with movable and folding components, shown in a collapsed configuration.
Figure 18:
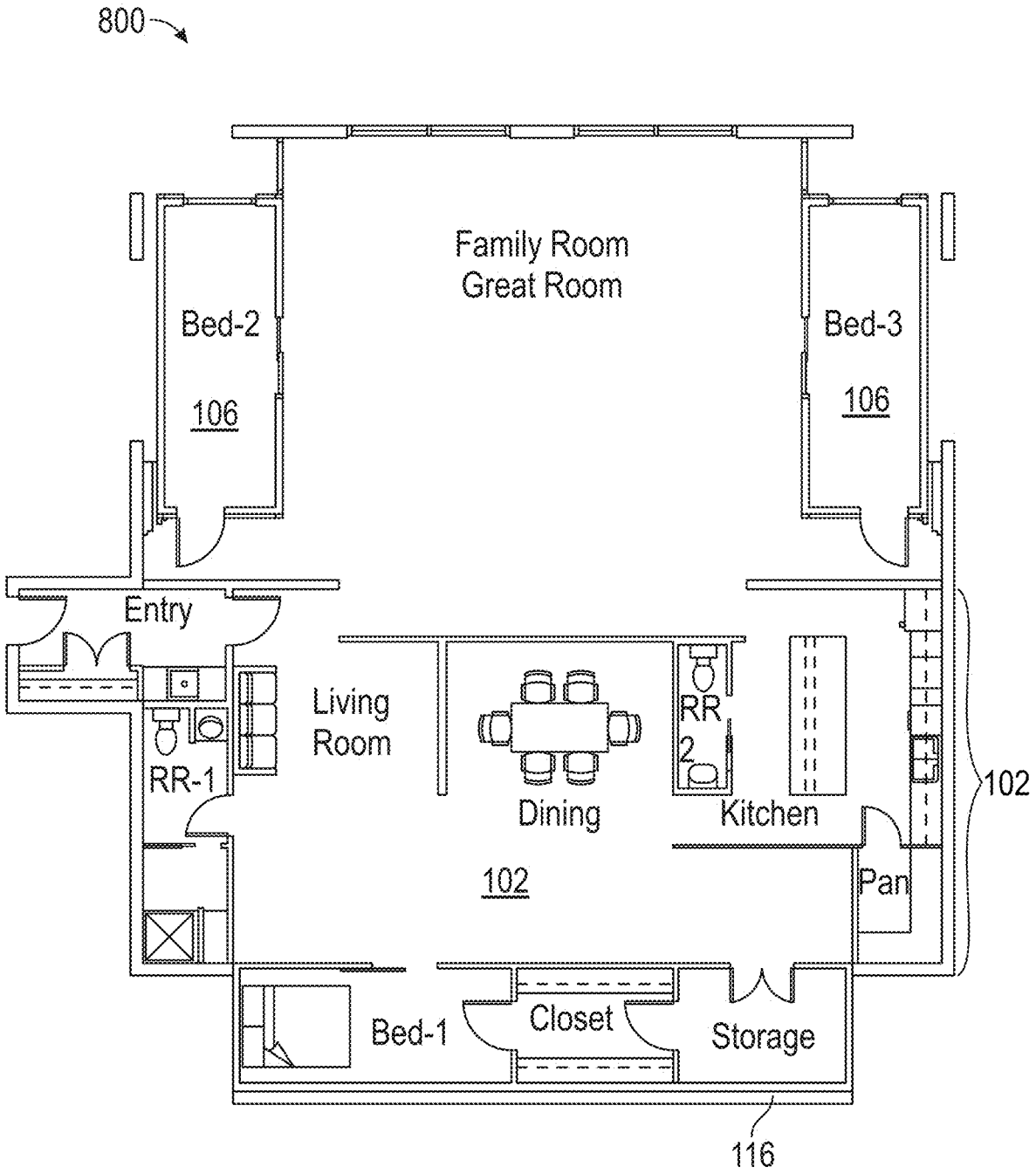
FIG. 18 is a schematic diagram illustrating an expandable building structure with movable and folding components, shown in an expanded configuration.
Figure 19:
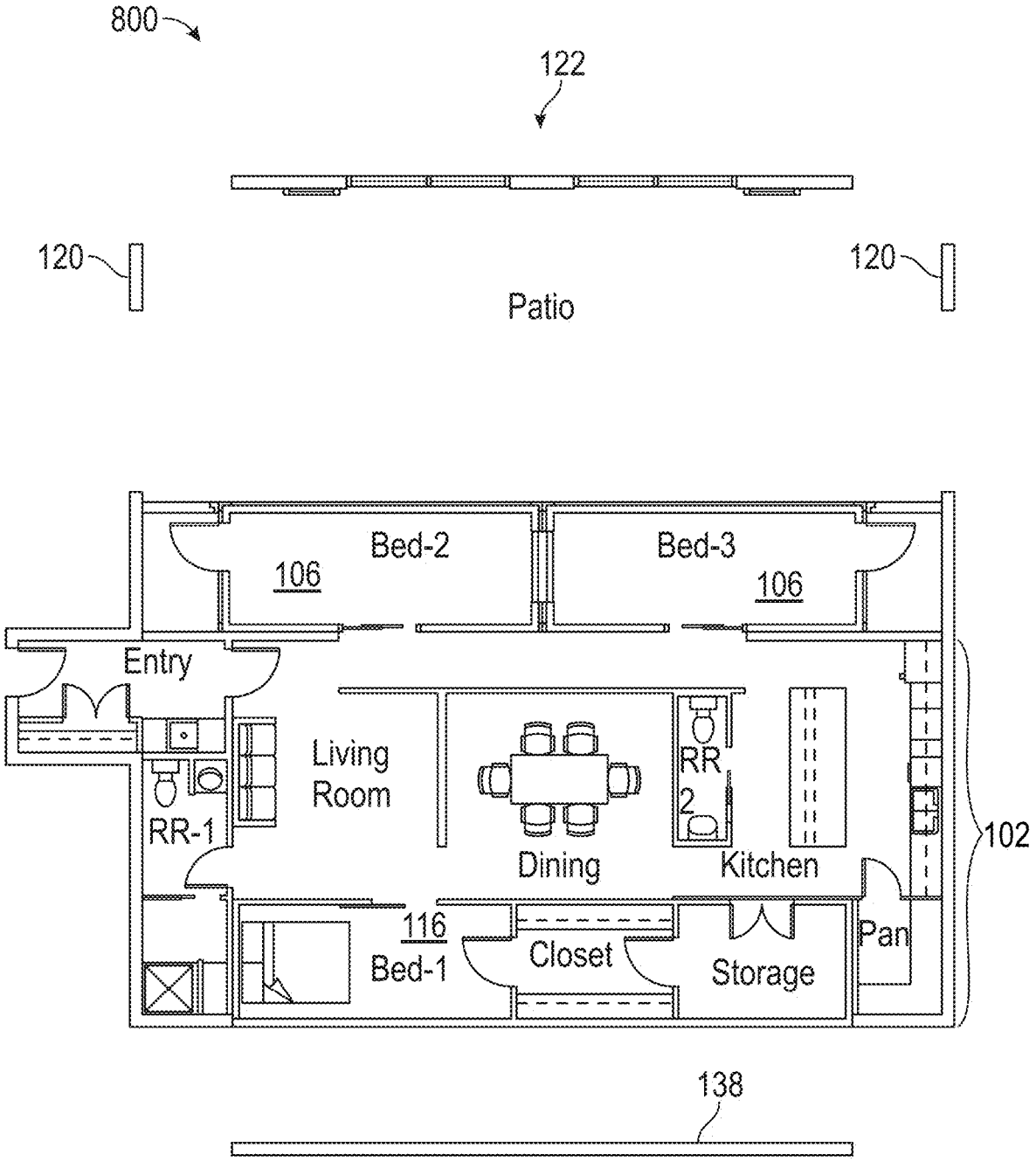
FIG. 19 is a schematic diagram illustrating an expandable building structure with movable and folding components, shown in a collapsed configuration.

FIGS. 16 and 17 illustrate an exemplary building structure 700 which can be deployed (FIG. 16) and collapsed (FIG. 17) as described herein. Similarly, FIGS. 18 and 19 illustrate an exemplary building structure 800 which can be deployed (FIG. 18) and collapsed (FIG. 19) as described herein. In both examples, the interior building choices can be made to accommodate the collapsing structures (e.g., mobile building units 106) and the sliding expanding structures (e.g., slidable building unit 116). For example, FIG. 16 illustrates a "family" room that is a living space provided in the deployed configuration.

Since at least some of this living space is in the path of the collapsing structures when moving to the collapsed configuration, preferably the materials selected for that secondary living space (e.g., furniture, fixtures, etc.) can be easily moved. Thus, for example, areas that require (or preferably have) permanent elements, such as plumbing (e.g., kitchen, bathrooms), heating and cooling equipment, and related utilities are preferably provided within portions of the central structure 102 that are unaffected by the movement of movable building units 106 and slidable building units 116.

One of the key benefits of keeping utilities and other permanent structures within the central structure, which is fixed to the ground and does not move, is the ability to ensure uninterrupted functionality and structural stability during transitions between the deployed and collapsed configurations. Since movable building units and slidable building units are designed to shift positions, areas within their path must remain flexible and free of permanent fixtures to accommodate movement. By housing essential utilities—such as plumbing for kitchens and bathrooms, heating and cooling systems, and electrical infrastructure—within the central structure, these critical systems are protected from disruption or damage caused by the reconfiguration of the modular building units.

In this manner, the central structure serves as a stable and immovable anchor, ensuring that these utilities remain operational regardless of the building's configuration. This design approach also simplifies maintenance and installation, as the fixed nature of the central structure allows for more robust and durable connections to the foundation and external utility networks. Additionally, concentrating permanent elements in the central structure optimizes the use of space in the movable units, allowing them to focus on providing adaptable living areas without the constraints of fixed systems. This arrangement enhances the overall efficiency, safety, and functionality of the modular building system.

FIGS. 16 and 17 also illustrate a control room with one or more motors 121 integrated into the modular building system to automate the movement of the movable units. For example, the control room can comprise one or more electric or hydraulic motors operatively coupled to the movable or slidable units.

Additional Details

To facilitate the movement of the movable and slidable units described herein, various mechanisms and elements can be employed to reduce friction and enable smooth transitions between configurations. For example, casters, wheels, rollers, skid plates, and tracks can be integrated into the lower surfaces of the movable building units and slidable building units. Casters, which may include swivel or fixed designs, allow for multidirectional movement and ease of deployment across a foundation or ground surface. Similarly, wheels and rollers can be used to provide linear motion, with options for locking mechanisms to secure the units in place once positioned. Skid plates, constructed from low-friction materials such as Teflon or similar composites, can be utilized to slide units across surfaces with minimal resistance. Tracks, which may be embedded into the foundation or attached to the units themselves, can guide the movement of slidable building units along predefined paths, ensuring precise alignment during deployment and retraction. These elements can be used individually or in combination to optimize the mobility and functionality of the modular building system.

Various mechanisms can be employed to provide controlled and efficient mobility. In some embodiments, motors can be integrated into the modular building system to automate the movement of these units. For example, electric or hydraulic motors can be operatively coupled to the movable or slidable units, enabling precise and smooth transitions between configurations. The motors can be controlled via wired or wireless systems, such as remote controls or integrated building management systems, to allow for user-friendly operation.

Alternatively, mechanical systems such as pulleys, winches, or gear assemblies can be utilized to manually or semi-automatically move the units. For instance, a pulley system may include cables or belts connected to the movable or slidable units, which can be operated by a crank or motorized winch to adjust the position of the units. Gear assemblies may also be employed to convert rotational motion into linear movement, providing a reliable and robust mechanism for repositioning the units.

To secure the movable and slidable units in both the deployed and collapsed configurations, various locking mechanisms can be employed to ensure stability and prevent unintended movement. For example, latches can be used to lock the units in place by engaging with corresponding catches or brackets mounted on the central structure or adjacent components. These latches may include spring-loaded designs to provide a secure and self-locking feature upon engagement. Additionally, mechanical locking pins can be inserted into aligned holes or slots in the movable or slidable units and the central structure to create a rigid connection. In some embodiments, cam locks or rotary locks can be utilized, which operate by rotating a cam or lever to engage and secure the units. For enhanced security, electromagnetic locks or solenoid-based locking systems can be integrated, allowing for remote or automated locking and unlocking. These locking mechanisms can be further supplemented with secondary elements, such as tension straps, clamps, or bolts, to provide additional reinforcement and ensure the units remain securely positioned during use.

As described herein, in some embodiments the movable building units can comprise shipping containers modified to serve as living spaces. The shipping containers can be modified by incorporating structural and functional enhancements tailored to residential or architectural applications. These modifications can include cutting and reinforcing openings for doors, windows, and ventilation systems to ensure adequate access, natural light, and airflow within the container. Insulation and interior paneling can be added to regulate temperature and create a comfortable living environment, while electrical wiring, plumbing, and HVAC systems can be installed to support modern amenities. The exterior of the container can be treated with weather-resistant coatings to protect against environmental elements, such as moisture, heat, and corrosion. Additionally, the container's structural integrity can be reinforced to withstand the stresses associated with movement and deployment, including the addition of hinges, casters, or tracks to facilitate mobility. These modifications transform standard shipping containers into versatile, durable, and adaptable units suitable for use in modular building systems.

In some embodiments, to enhance the fire resistance of the modular building structures, various treatments and materials can be applied to the components of the buildings. For example, fire-retardant coatings can be applied to walls, ceilings, and other structural elements to slow the spread of flames and reduce heat transfer. Additionally, structural components can be constructed from or reinforced with fire-resistant materials such as gypsum board, concrete, or steel, which are designed to resist combustion and maintain structural integrity under high heat.

In some embodiments, the use of treated wood or engineered wood products for the moveable/slidable units and central structure, such as cross-laminated timber (CLT) treated with fire-retardant chemicals, can provide both strength and enhanced fire resistance. Furthermore, fire-resistant glazing can be used for windows and doors, incorporating materials such as tempered glass or multi-layered glass with fire-resistant interlayers to prevent breakage and maintain a barrier against flames and heat. These treatments and materials collectively can improve the fire resistance of the building, ensuring greater safety and durability during fire events.

Further aspects of the present disclosure are provided by the subject matter of the following clauses.

In a first example, a modular building structure comprises a central structure fixedly mounted to a foundation, the central structure having a plurality of walls defining a primary living space; one or more free-standing supports positioned adjacent to the central structure, the free-standing supports configured to provide structural reinforcement to the modular building structure; one or more movable building units operatively coupled to the central structure, each movable building unit having a plurality of walls defining a secondary living space, the movable building units configured to transition between a deployed configuration and a collapsed configuration, wherein in the deployed configuration, the modular building structure defines a first building footprint of a first size, and in the collapsed configuration, the modular building structure defines a second building footprint of a second size smaller than the first size; and a roof structure fixedly mounted to the central structure and supported by the free-standing supports, the roof structure configured to provide coverage over the primary living space and at least a portion of the secondary living space in the deployed configuration; wherein the free-standing supports and the central structure remain stationary during transitions between the deployed and collapsed configurations, and the movable building units are reconfigurable relative to the central structure.

A building structure as in any preceding clause, further comprising at least one slidable building unit operatively associated with the central structure, the slidable building unit configured to extend outward from the central structure in the deployed configuration and to retract at least partially into the central structure in the collapsed configuration; and the slidable building units are reconfigurable relative to the central structure.

A building structure as in any preceding clause, wherein the free-standing supports are constructed from materials selected from the group consisting of steel, reinforced concrete, aluminum, and treated wood.

A building structure as in any preceding clause, wherein the free-standing supports are anchored to the ground using concrete footings reinforced with steel rebar.

A building structure as in any preceding clause, wherein the roof structure is configured to extend beyond the footprint of the central structure to provide coverage for the secondary living space in the deployed configuration.

A building structure as in any preceding clause, wherein the movable building units are formed from modified shipping containers.

A building structure as in any preceding clause, further comprising locking mechanisms configured to secure the movable building units in the deployed configuration and the collapsed configuration.

A building structure as in any preceding clause, wherein the slidable building unit is supported by casters, wheels, or tracks to facilitate movement between the deployed and collapsed configurations.

A building structure as in any preceding clause, wherein the free-standing supports include adjustable or telescoping elements to accommodate varying roof heights or configurations.

A building structure as in any preceding clause, wherein the movable building units include folding wall panels pivotably connected by hinges, the folding wall panels configured to collapse into a stacked arrangement in the collapsed configuration.

A building structure as in any preceding clause, wherein the roof structure includes fire-resistant materials to enhance protection during environmental events.

A building structure as in any preceding clause, the modular building structure of claim 1, further comprising a motorized system operatively coupled to the movable building units and slidable building units to automate transitions between the deployed and collapsed configurations.

In another example a modular building structure may include: a central structure with a plurality of walls that defines a first living space, the central structure being anchored to a foundation to prevent movement of the central structure relative to the ground; one or more one movable building unit, each of the movable building units having a plurality of walls that defines a respective secondary living space, the one or more moveable building unit being moveably coupled to the central structure, where the at least one movable building unit is configured to be moveable, relative to the central structure, between a deployed configuration and a collapsed configuration, where in the deployed configuration, the modular building structure defines a first building footprint, the first building footprint having a first size, where in the collapsed configuration, the modular building structure defines a second building footprint, the second building footprint having a second size that is smaller than the first size, and where in the collapsed configuration, the movable building unit covers at least a portion of one or more of the plurality of walls of the central structure.

The modular building structure of any preceding clause, further may include: at least one slidable building unit operatively associated with the central structure and configured to extend outward from the central structure in the deployed configuration and to retract at least partially into the central structure in the collapsed configuration.

The modular building structure of any preceding clause, further may include: one or more support elements configured to secure and stabilize the movable building unit when in the deployed configuration.

The modular building structure of any preceding clause where the at least one movable building unit may include: a first folding wall panel and a second folding wall panel pivotably secured to one another by at least one wall panel hinge, where the first folding wall panel is coupled to a respective one of the one or more movable building units by a building hinge.

The modular building structure of any preceding clause, where a plurality of caster are provided on a lower surface of at least one of the one or more movable building units to facilitate movement between the deployed configuration and the collapsed configuration.

The modular building structure of any preceding clause, where the movable building unit is configured to be secured to one or more support elements into the deployed configuration via one or more locking mechanisms.

The modular building structure of any preceding clause, further may include: a roof structure fixedly mounted to the central structure, where the movable building unit is moveable relative to the roof structure.

The modular building structure of any preceding clause, further may include: one or more free-standing support structures, where the roof structure is fixedly mounted to the one or more free-standing support structures.

The modular building structure of any preceding clause, where the movable building unit is formed from a shipping container.

In another examples, a method of constructing a modular reconfigurable building structure may include: providing a foundation; securing a central structure to the foundation, the central structure may include a plurality of walls that define a first living space; moveably coupling one or more movable building units to the central structure, each of the one or more movable building units having a plurality of walls that define a corresponding secondary living space, where the one or more movable building units are configured to move between a deployed configuration and a collapsed configuration, where in the deployed configuration the building structure defines a first building footprint having a first size, and in the collapsed configuration the building structure defines a second building footprint having a second size that is smaller than the first size;

The method of any preceding clause, further may include; coupling at least one slidable building unit to the central structure, the slidable building unit being configured to extend outward in the deployed configuration and to retract into the central structure in the collapsed configuration.

The method of any preceding clause, further may include: providing and anchoring one or more support elements to the ground to secure and stabilize the movable building unit when in the deployed configuration.

The method of any preceding clause, further may include: pivotably coupling a first folding wall panel and a second folding wall panel to the movable building unit. where the first folding wall panel is coupled to the movable building unit by at least one building hinge and the second folding wall panel is coupled to the first folding wall panel by at least one wall panel hinge.

The method of any preceding clause, further may include: providing a plurality of casters on a lower surface of the movable building unit to facilitate movement between the deployed configuration and the collapsed configuration;

The method of any preceding clause, further may include: installing a roof structure fixedly mounted to the central structure, where the movable building unit is moveable relative to the roof structure;

The method of any preceding clause, further may include: forming the movable building unit from a modified shipping container.

In another example, a method of deploying and collapsing a modular building structure is provided, the method may include: moving one or more movable building units coupled to a central structure from a deployed configuration, in which the movable building units extend outward from the central structure to form an expanded building footprint defining an increased living space to a collapsed configuration, in which at least some of the movable building units are arranged adjacent to the central structure; engaging one or more locking mechanisms to secure the movable building units in the collapsed configuration.

The method of any preceding clause, where the one or more movable building units are moved from the deployed configuration to the collapsed configuration by operating a motor operatively coupled to the movable building units.

The method of any preceding clause, where the one or more movable building units are moved by pivoting a respective one of the building units about one or more hinge members and/or retracting a respective one of the building units in the central structure's interior space.

In view of the many possible embodiments to which the principles of the disclosed technology may be applied, it should be recognized that the illustrated embodiments are only preferred examples and should not be taken as limiting the scope of the disclosure. Rather, the scope of the disclosure is at least as broad as the following claims and equivalents of the recited features. We therefore claim all that comes within the scope and spirit of these claims.

The invention claimed is:

1. A modular building structure comprising:

a central structure with a plurality of walls that defines a first living space, the central structure being anchored to a foundation to prevent movement of the central structure relative to the ground;

a movable building unit, the movable building unit having a plurality of walls that defines a respective secondary living space, the movable building unit being moveably coupled to the central structure, wherein the movable building unit is configured to be moveable, relative to the central structure, between a deployed configuration and a collapsed configuration, and wherein in the collapsed configuration, at least one wall of one of the movable building unit is a covering wall that covers at least a portion of one of the plurality of walls of the central structure, and in the deployed configuration, the covering wall is spaced apart from the central structure, wherein the movable building unit comprises a first folding wall panel and a second folding wall panel pivotably secured to one another by at least one wall panel hinge, and wherein the first folding wall panel is coupled to a respective one of the one or more movable building units by a building hinge.

2. The modular building structure of claim 1, further comprising:

at least one slidable building unit operatively associated with the central structure and configured to extend outward from the central structure in the deployed configuration and to retract at least partially into the central structure in the collapsed configuration.

3. The modular building structure of claim 1, further comprising:

one or more support elements configured to secure and stabilize the movable building unit when in the deployed configuration.

4. The modular building structure of claim 1, wherein a plurality of caster are provided on a lower surface of the movable building unit to facilitate movement between the deployed configuration and the collapsed configuration.

5. The modular building structure of claim 1, wherein the movable building unit is configured to be secured to one or more support elements into the deployed configuration via one or more locking mechanisms.

6. The modular building structure of claim 1, further comprising:

a roof structure fixedly mounted to the central structure, wherein the movable building unit is moveable relative to the roof structure.

7. The modular building structure of claim 6, further comprising:

one or more free-standing support structures, wherein the roof structure is fixedly mounted to the one or more free-standing support structures.

8. The modular building structure of claim 6, wherein the movable building unit is formed from a shipping container.

9. A method of constructing a modular reconfigurable building structure comprising:

providing a foundation;

securing a central structure to the foundation, the central structure comprising a plurality of walls that define a first living space; and moveably coupling a movable building unit to the central structure, the movable building unit having a plurality of walls that define a corresponding secondary living space;

installing a roof structure fixedly mounted to the central structure, wherein the movable building unit is moveable relative to the roof structure; and mounting the roof structure to one or more free-standing support structures, wherein the movable building unit is configured to move between a deployed configuration and a collapsed configuration, and wherein in the collapsed configuration, at least one wall of the one or more movable building unit is a covering wall that covers at least a portion of one of the plurality of walls of the central structure, and in the deployed configuration, the covering wall is spaced apart from the central structure.

10. The method of claim 9, further comprising;

coupling at least one slidable building unit to the central structure, the slidable building unit being configured to extend outward in the deployed configuration and to retract into the central structure in the collapsed configuration.

11. The method of claim 9, further comprising:

providing and anchoring one or more support elements to the ground to secure and stabilize the movable building unit when in the deployed configuration.

12. The method of claim 9, further comprising:

pivotably coupling a first folding wall panel and a second folding wall panel to the movable building unit, wherein the first folding wall panel is coupled to the movable building unit by at least one building hinge and the second folding wall panel is coupled to the first folding wall panel by at least one wall panel hinge.

13. The method of claim 9, further comprising:

providing a plurality of casters on a lower surface of the movable building unit to facilitate movement between the deployed configuration and the collapsed configuration.

14. The method of claim 9, further comprising:

forming the movable building unit from a modified shipping container.

15. The modular building structure of claim 1, wherein in the deployed configuration, the modular building structure defines a first building footprint, the first building footprint having a first size, and wherein in the collapsed configuration, the modular building structure defines a second building footprint, the second building footprint having a second size that is smaller than the first size.

16. A modular building structure comprising:

a central structure with a plurality of walls that defines a first living space, the central structure being anchored to a foundation to prevent movement of the central structure relative to the ground;

a movable building unit, the movable building unit having a plurality of walls that defines a respective secondary living space, the movable building unit being moveably coupled to the central structure;

a roof structure fixedly mounted to the central structure, wherein the movable building unit is movable relative to the roof structure; and one or more free-standing support structures, wherein the roof structure is fixedly mounted to the one or more free-standing support structures, wherein the movable building unit is configured to be moveable, relative to the central structure, between a deployed configuration and a collapsed configuration, and wherein in the collapsed configuration, at least one wall of one of the movable building unit is a covering wall that covers at least a portion of one of the plurality of walls of the central structure, and in the deployed configuration, the covering wall is spaced apart from the central structure.

17. The modular building structure of claim 16, further comprising:

at least one slidable building unit operatively associated with the central structure and configured to extend outward from the central structure in the deployed configuration and to retract at least partially into the central structure in the collapsed configuration.

18. The modular building structure of claim 16, further comprising:

one or more support elements configured to secure and stabilize the movable building unit when in the deployed configuration.

19. The modular building structure of claim 16, wherein the movable building unit is configured to be secured to one or more support elements into the deployed configuration via one or more locking mechanisms.

20. A method of constructing a modular reconfigurable building structure comprising:

providing a foundation;

securing a central structure to the foundation, the central structure comprising a plurality of walls that define a first living space;

moveably coupling a movable building unit to the central structure, the movable building unit having a plurality of walls that define a corresponding secondary living space; and pivotably coupling a first folding wall panel and a second folding wall panel to the movable building unit, wherein the first folding wall panel is coupled to the movable building unit by at least one building hinge and the second folding wall panel is coupled to the first folding wall panel by at least one wall panel hinge, wherein the movable building unit is configured to move between a deployed configuration and a collapsed configuration, and wherein in the collapsed configuration, at least one wall of the one or more movable building unit is a covering wall that covers at least a portion of one of the plurality of walls of the central structure, and in the deployed configuration, the covering wall is spaced apart from the central structure.

* * * * *